US006346799B2

(12) United States Patent
Renous

(10) Patent No.: US 6,346,799 B2
(45) Date of Patent: Feb. 12, 2002

(54) VOLTAGE REGULATOR WITH A BALLAST TRANSISTOR AND CURRENT LIMITER

(75) Inventor: Claude Renous, Grenoble (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/735,392

(22) Filed: Dec. 11, 2000

(30) Foreign Application Priority Data

Dec. 13, 1999 (FR) ..... 99 15668

(51) Int. Cl.[7] ..... G05F 1/40; G05F 1/44; G05F 1/56

(52) U.S. Cl. ..... 323/274; 323/280; 323/908

(58) Field of Search ..... 323/274, 275, 323/276, 280, 281, 908, 901

(56) References Cited

U.S. PATENT DOCUMENTS

| | | | | | |
|---|---|---|---|---|---|
| 4,816,740 | A | | 3/1989 | Maier | 323/275 |
| 5,280,233 | A | * | 1/1994 | Poletto et al. | 323/269 |
| 5,355,077 | A | | 10/1994 | Kates | 323/224 |
| 5,408,173 | A | | 4/1995 | Knapp | 323/285 |
| 5,512,814 | A | * | 4/1996 | Allman | 323/269 |
| 5,548,205 | A | * | 8/1996 | Monticelli | 323/274 |
| 5,559,424 | A | * | 9/1996 | Wrathall et al. | 323/277 |
| 5,861,737 | A | | 1/1999 | Goerke et al. | 323/282 |
| 5,864,227 | A | * | 1/1999 | Borden et al. | 323/280 |
| 5,939,867 | A | * | 8/1999 | Capici et al. | 323/277 |
| 6,150,800 | A | * | 11/2000 | Kinoshit et al. | 323/280 |

* cited by examiner

*Primary Examiner*—Bao Q. Vu
(74) *Attorney, Agent, or Firm*—Theodore E. Galanthay; Allen, Dyer, Doppelt, Milbrath & Gilchrist, P.A.

(57) ABSTRACT

A voltage regulator with a current limiter includes a voltage regulating circuit including an amplifier circuit and a feedback circuit. The amplifier circuit includes a ballast or pass resistor and the feedback circuit supplies a first feedback voltage to the amplifier circuit, which is compared to a reference voltage. The voltage regulator further includes a current limiter circuit including a current limiter transistor in series with the ballast transistor and an output of the voltage regulator and a feedback circuit supplying a second feedback voltage to a controller for controlling the current limiter transistor. The controller causes the current limiter transistor to operate between saturation and blocking conditions depending on whether the second feedback voltage, which is representative of the output of the voltage regulator, is above or below a predetermined threshold voltage.

28 Claims, 2 Drawing Sheets

VOLTAGE REGULATOR WITH A BALLAST TRANSISTOR AND CURRENT LIMITER

FIELD OF THE INVENTION

The present invention relates to electronic circuits and, more particularly, to voltage regulators including a ballast or pass resistor and a current limiter.

BACKGROUND OF THE INVENTION

Certain voltage regulators may be equipped with a so-called pass or ballast transistor positioned in series with a regulator input and output. These voltage regulators operate by using a potential barrier voltage reference, for example, and the output voltage is regulated by feedback. Such regulators are well known in the art, particularly for implementing integrated regulators.

If a short circuit occurs between the regulator output terminals, the input voltage of the regulator appears at the terminals of the ballast transistor. This may result in an excessive current flowing through the ballast transistor, potentially resulting in the destruction thereof. One approach to limiting this current involves adding a current limiting circuit including a low value resistor (e.g. 1 ohm) in series with the ballast transistor.

High density complementary metal-oxide semiconductor ("HCMOS") technology has been developed for increasing the integration density of integrated circuits. An integrated regulator obtained by using HCMOS technology must supply a regulated voltage of 3.3 V for an input voltage of 5 V. The ballast transistor tolerates a maximum voltage of 5 V between its terminals. In the case of a short circuit at the regulator output, protection of the ballast transistor must be very rapid and efficient.

SUMMARY OF THE INVENTION

The present invention provides a rapid and efficient protection to a ballast transistor of a voltage regulator.

This and other objects, features, and advantages in accordance with the present invention are provided by a voltage regulator having a current limiter for regulating an input voltage and for delivering an output voltage. The voltage regulator may be implemented using HCMOS technology, for example. The voltage regulator may include a voltage regulating circuit including an amplifier circuit and a first feedback circuit. The amplifier circuit may include a ballast transistor, and the first feedback circuit supplies a first feedback voltage representative of the voltage regulated by the ballast transistor to the amplifier circuit for comparison with a reference voltage.

The voltage regulator may further include a limiting circuit including a current limiting transistor connected in series with the ballast transistor and an output of the voltage regulator, a controller for biasing the current limiting transistor, and a second feedback circuit supplying a second feedback voltage representative of a voltage at the output to the controller. The controller makes the current limiting transistor operate between saturation and blocking conditions, depending on whether the second feedback voltage is above or below a predetermined threshold voltage. The first and second feedback circuits may each include a resistor-equipped voltage divider.

The voltage regulator may also include a differential amplifier having first and second inputs of opposite polarity, the first input receiving the reference voltage and the second input receiving the first feedback voltage. An output voltage of the differential amplifier controls the ballast transistor. The second feedback voltage corresponding to the current limiting part is supplied to a third input having an opposite polarity of the first input. A fraction of the output voltage may be connected to the controller to provide a control voltage therefor. The controller may be a comparator, for example, having a first input receiving the reference voltage, a second input receiving the control voltage, and an output connected to the current limiting transistor. The output voltage fraction may be provided by a transistor sized in accordance with the ballast transistor.

BRIEF DESCRIPTION OF THE DRAWINGS

The invention will be better understood and other advantages and features will become apparent from the following description and accompanying drawings presented by way of non-limiting example, in which.

DETAILED DESCRIPTION OF THE PREFERRED EMBODIMENTS

Figure 1:
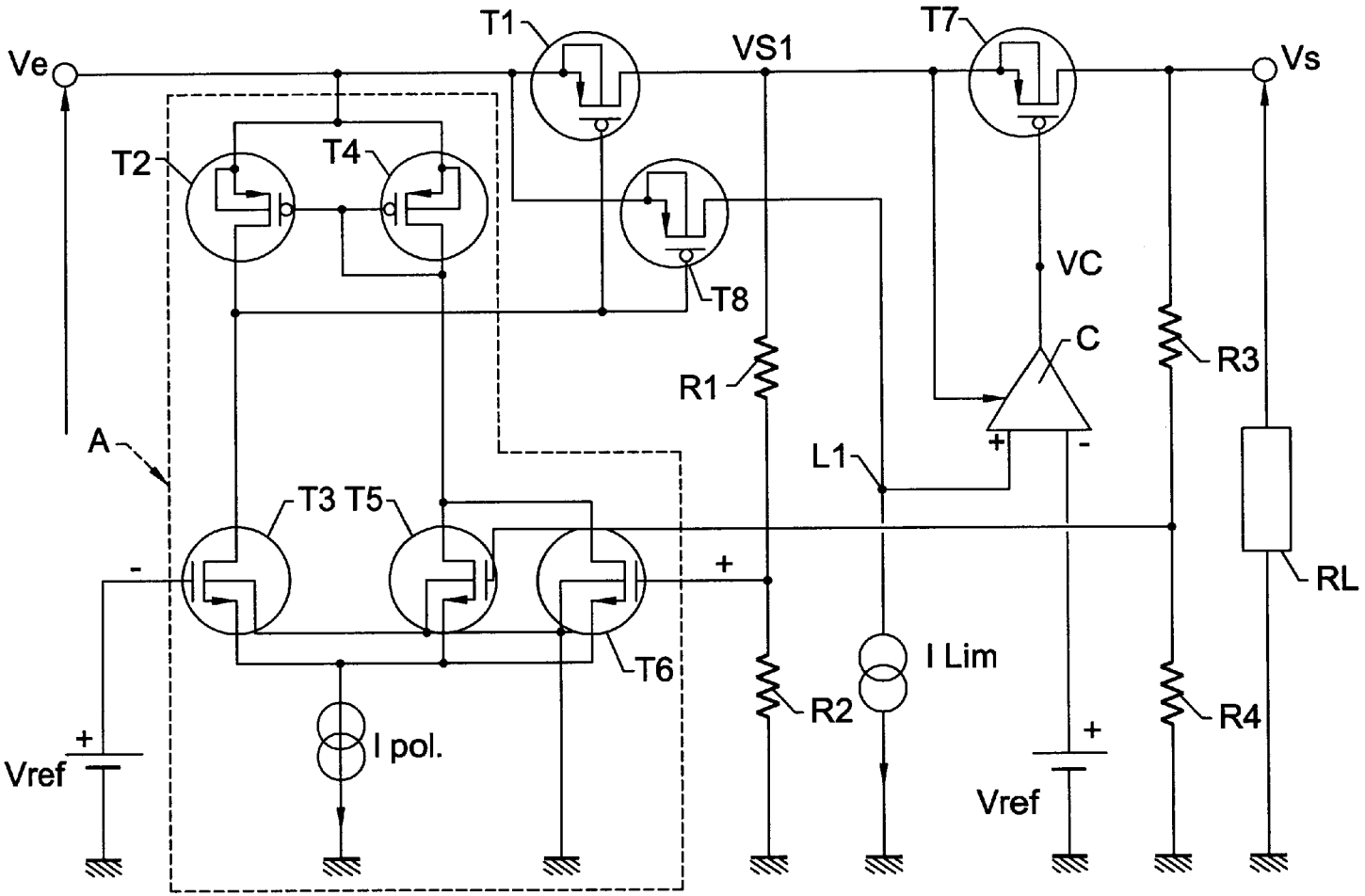
FIG. 1 is a schematic circuit diagram of a voltage regulator having a ballast transistor and a current limiter according to the present invention.

Referring now to FIG. 1, a voltage regulator having a current limiter in accordance with the present invention is first described. The voltage regulator regulates an input voltage Ve, which may vary between about 4 and 5.5 V, for example, and supplies an output voltage Vs of about 3.3 V to a load RL. The voltage regulator may include transistors implemented using HCMOS technology and tolerating a voltage limit of about 3.6 V, for example.

The voltage regulator includes a voltage regulator circuit including a ballast or pass transistor T1 and a differential amplifier. The ballast transistor T1 is a PMOS transistor whose source is connected to a substrate. An output of the voltage regulator circuit delivers a voltage VS1 to a voltage divider bridge including resistors R1 and R2. A common point between the resistors R1 and R2 is connected to a noninverting input of the differential amplifier A, whose inverting input is connected to the reference voltage Vref.

The differential amplifier A is supplied between the input voltage Ve and ground and includes two parallel branches connected to a current generator Ipol for biasing the differential amplifier. The first branch includes transistors T2 and T3 in series. The second branch includes a transistor T4 in series with the parallel transistors T5 and T6. Transistor T2 and T4 are PMOS transistors forming a current mirror. The transistors T2, T4 have their gates connected and each has its source connected to the substrate.

Transistors T3, T5 and T6 are NMOS transistors with a common substrate and whose sources are connected to the current generator Ipol. The gate of transistor T3 provides an inverting input of the differential amplifier A, and the gates of transistors T5 and T6 provide two noninverting inputs of the differential amplifier, respectively. The common point between the resistors R1 and R2 is connected to the gate of transistor T6.

The current limiting circuit includes a transistor T7 connected in series between the ballast transistor and the output of the voltage regulator circuit. Transistor T7 is a PMOS transistor, whose source is connected to the substrate. Thus, the drain of transistor T1 is connected to the source of transistor T7. The drain of transistor T7 provides an output for the voltage regulator. A voltage dividing bridge formed by resistors R3 and R4 is connected between the regulator output and ground. The common point between the resistors R3 and R4 is connected to the other noninverting input of the differential amplifier A, i.e., to the gate of transistor T5.

The output of a comparator C, supplied with a voltage VS1, is connected to the gate of transistor T7. A negative input of the comparator C is connected to the voltage Vref, and a positive input of the comparator is connected to a point L1. The point L1 is common to the drain of the PMOS transistor T8 and to a current source ILim. The source of transistor T8, which is connected to the substrate, is also connected to the input voltage Ve. The output of the differential amplifier A is connected to the gates of transistors T1 and T8.

In normal operation, the voltage at the output of the ballast transistor T1 is:

$$VS1 = Vref\ x = \frac{R1 + R2}{R2}$$

when the gates of transistors T3, T5 and T6 are at the same potential. The resistors R1 and R2 are selected so that VS1=3.5 V. Transistors T1 and T8 are sized as follows:

Ww/Lw for T1

Ww/Lw/1000 for T8

When the current in transistor T8 remains below the current source ILim, the output of comparator C is at substantially zero volts. The transistor T7 is conductive and operates in the linear zone. The difference VS1−Vs is preferably below 200 mV so that voltage regulation takes place by the resistive bridge R3–R4.

When the current in transistor T8 exceeds ILim, the voltage at point L1 exceeds Vref and the voltage VC at the output of comparator C becomes equal to VS1. Transistor T7 is then regulated as a function of the load RL to regulate the current such that the voltage at point L1 becomes substantially equal to Vref. The voltage Vs drops from about 3.3 V to zero in accordance with the limitation characteristic. The voltage VS1 is then regulated by the ratio R1/R2, because the voltage Vs drops below 3.3 V. Thus, the invention provides a regulation on the load in the normal mode and a regulation on the voltage VS1 in the current limitation mode. The transistors TS and T6 carry out a continuous switching between the two modes.

Figure 2:
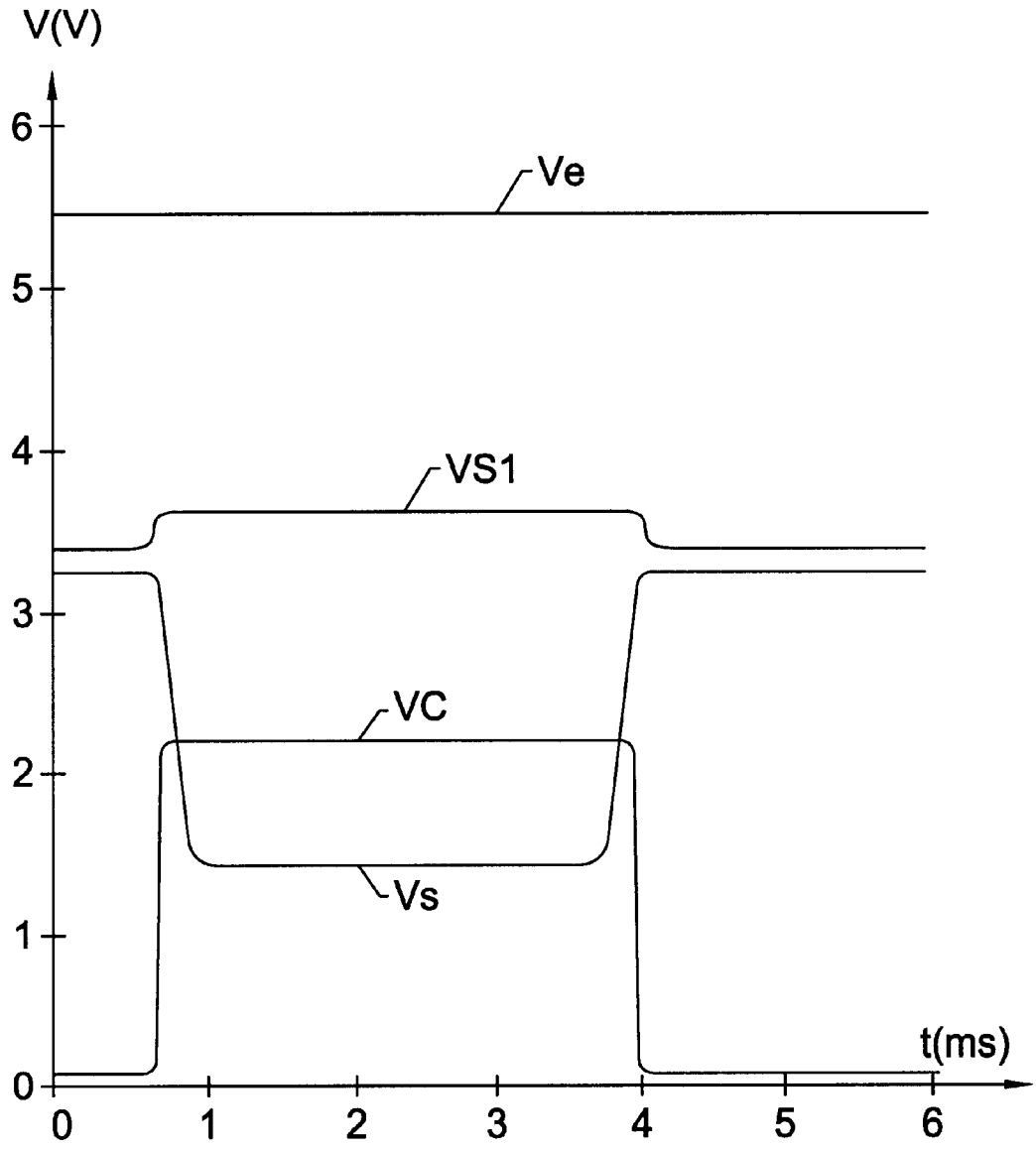
FIG. 2 is a graphical illustration of the operation of the regulator of FIG. 1.

Turning now to FIG. 2, a graph showing the input voltage Ve, the output voltage Vs, the voltage VS1 at the output of the ballast transistor T1, and the voltage Vc at the output of comparator C is provided. The ordinate axis represents voltage in volts and the abscissa axis represents time in milliseconds. The graph illustrates the efficiency of the regulator according to the invention. It may be seen that when the voltage VS drops suddenly the voltage Vc at the output of the comparator C rises suddenly. The return to the normal situation takes place just as rapidly.

That which is claimed is:

1. A voltage regulator comprising:

a voltage regulating circuit comprising an amplifier circuit comprising a ballast transistor for regulating an input voltage, and a first feedback circuit supplying a first feedback voltage corresponding to the regulated input voltage to said amplifier circuit, said amplifier circuit comparing the first feedback voltage and a reference voltage; and a current limiting circuit comprising a current limiting transistor connected in series with said ballast transistor and an output, a second feedback circuit supplying a second feedback voltage corresponding to the output voltage, and a controller receiving the second feedback voltage and causing said current limiting transistor to operate between saturation and blocking conditions responsive to the second feedback voltage.

2. The voltage regulator of claim 1 wherein said controller causes said current limiting transistor to operate between saturation and blocking conditions responsive to the second feedback voltage being above or below a threshold.

3. The voltage regulator of claim 1 wherein the first feedback circuit comprises a voltage divider.

4. The voltage regulator of claim 3 wherein the voltage divider comprises a pair of resistors connected in series.

5. The voltage regulator of claim 1 wherein the second feedback circuit comprises a voltage divider.

6. The voltage regulator of claim 5 wherein the voltage divider comprises a pair of resistors connected in series.

7. The voltage regulator of claim 1 wherein the voltage regulating circuit comprises a differential amplifier having first, second, and third inputs and an output, the first input corresponding to a first polarity and the second and third inputs corresponding to a second polarity opposite the first polarity, the first input receiving the reference voltage, the second input receiving the first feedback voltage, the third input receiving the second feedback voltage, and the output being connected to said ballast transistor.

8. The voltage divider of claim 7 wherein the first polarity is positive and the second polarity is negative.

9. The voltage regulator of claim 1 wherein a fraction of the output voltage is provided to said controller to thereby provide a control voltage therefor.

10. The voltage regulator of claim 9 further comprising a transistor sized proportionally to said ballast transistor to provide the fraction of the output voltage.

11. The voltage regulator of claim 1 wherein said controller comprises a comparator having a first input receiving the reference voltage, a second input receiving the control voltage, and an output connected to said current limiting transistor.

12. The voltage regulator of claim 1 wherein the voltage regulator and current limiting circuits are high density complementary metal-oxide semiconductor circuits.

13. The voltage regulator of claim 12 wherein said controller causes said current limiting transistor to operate between saturation and blocking conditions responsive to the second feedback voltage being above or below a threshold.

14. A voltage regulator comprising:

a voltage regulating circuit comprising an amplifier circuit comprising a ballast transistor for regulating an input voltage, and a first voltage divider circuit supplying a first feedback voltage corresponding to the regulated input voltage to said amplifier circuit, said amplifier circuit comparing the first feedback voltage and a reference voltage; and a current limiting circuit comprising a current limiting transistor connected in series with said ballast transistor and an output, a second voltage divider circuit supplying a second feedback voltage corresponding to the output voltage, and a controller receiving the second feedback voltage and causing said current limiting transistor to operate between saturation and blocking conditions responsive to the second feedback voltage.

15. The voltage regulator of claim 14 wherein said controller causes said current limiting transistor to operate between saturation and blocking conditions responsive to the second feedback voltage being above or below a threshold.

16. The voltage regulator of claim 14 wherein the voltage divider comprises a pair of resistors connected in series.

17. The voltage regulator of claim 14 wherein the voltage regulating circuit comprises a differential amplifier having first, second, and third inputs and an output, the first input corresponding to a first polarity and the second and third inputs corresponding to a second polarity opposite the first polarity, the first input receiving the reference voltage, the second input receiving the first feedback voltage, the third input receiving the second feedback voltage, and the output being connected to said ballast transistor.

18. The voltage divider of claim 17 wherein the first polarity is positive and the second polarity is negative.

19. The voltage regulator of claim 14 wherein a fraction of the output voltage is provided to said controller to thereby provide a control voltage therefor.

20. The voltage regulator of claim 19 further comprising a transistor sized proportionally to said ballast transistor to provide the fraction of the output voltage.

21. The voltage regulator of claim 14 wherein said controller comprises a comparator having a first input receiving the reference voltage, a second input receiving the control voltage, and an output connected to said current limiting transistor.

22. The voltage regulator of claim 14 wherein the voltage regulator and current limiting circuits are high density complementary metal-oxide semiconductor circuits.

23. A method for delivering a regulated output voltage comprising:

supplying an input voltage to a ballast transistor for regulating the input voltage;

providing a first feedback voltage from a first feedback circuit to the ballast transistor for comparison with a reference voltage, the first feedback circuit being connected between the regulated input voltage and the ballast transistor;

providing a current limiting transistor in series with the ballast transistor and an output; and providing a second feedback voltage from a second feedback circuit to a controller, the second feedback circuit being connected between the output voltage and the controller, and the controller causing the current limiting transistor to operate between saturation and blocking conditions responsive to the second feedback voltage.

24. The method of claim 23 wherein the controller causes the current limiting transistor to operate between saturation and blocking conditions responsive to the second feedback voltage being above or below a threshold.

25. The method of claim 23 wherein the first feedback circuit comprises a voltage divider comprising a pair of resistors connected in series.

26. The method of claim 23 wherein connecting the second feedback circuit comprises connecting a voltage divider comprising a pair of resistors connected in series.

27. The method of claim 23 further comprising providing a control voltage for the controller by connecting a transistor between the output voltage and the controller.

28. The method of claim 27 further comprising sizing the transistor in proportion to the ballast transistor to cause the control voltage to be a fraction of the output voltage.

* * * * *